US009656826B2

(12) United States Patent
Miyazaki et al.

(10) Patent No.: US 9,656,826 B2
(45) Date of Patent: May 23, 2017

(54) SHEET POST-PROCESSING APPARATUS AND IMAGE FORMING SYSTEM INCLUDING SAME

(71) Applicant: KYOCERA Document Solutions Inc., Osaka (JP)

(72) Inventors: Masahiko Miyazaki, Osaka (JP); Yoshiyuki Asakawa, Osaka (JP); Masuo Kawamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/193,919

(22) Filed: Jun. 27, 2016

(65) Prior Publication Data

US 2017/0001826 A1 Jan. 5, 2017

(30) Foreign Application Priority Data

Jul. 2, 2015 (JP) ..... 2015-133714

(51) Int. Cl.
*B65H 31/26* (2006.01)
*B65H 29/14* (2006.01)
(Continued)

(52) U.S. Cl.
CPC ..... *B65H 31/26* (2013.01); *B65H 29/14* (2013.01); *B65H 31/3027* (2013.01); *B65H 33/08* (2013.01); *B65H 2301/4212* (2013.01); *B65H 2301/4213* (2013.01); *B65H 2404/1312* (2013.01); *B65H 2404/15212* (2013.01); *B65H 2404/693* (2013.01);
(Continued)

(58) Field of Classification Search
CPC ..... B65H 31/30; B65H 31/26; B65H 29/14; B65H 2408/114; B65H 2408/1143; B65H 2408/12; B65H 2801/24; B65H 2801/27; B65H 37/04; B42C 1/12; B42C 1/125; B41L 43/12; G03G 2215/00822
USPC ..... 271/220
See application file for complete search history.

(56) References Cited

U.S. PATENT DOCUMENTS 5,026,034 A * 6/1991 Russel ..... B65H 29/14 271/211
6,244,583 B1 * 6/2001 Ohmichi ..... B65H 29/22 270/58.07

(Continued)

FOREIGN PATENT DOCUMENTS

JP 2012-180215 A 9/2012

*Primary Examiner* — David H Bollinger
(74) *Attorney, Agent, or Firm* — Stein IP, LLC

(57) ABSTRACT

A sheet post-processing apparatus includes a processing tray, a shift member, a discharge tray, a discharge roller pair, and a pressing member. The shift member moves a sheet loaded on the processing tray in a sheet width direction. The discharge roller pair discharges a sheet on the processing tray onto the discharge tray. The pressing member presses down a sheet discharged onto the discharge tray. The pressing member has an arm portion which rotates in the sheet conveyance direction about a rotation fulcrum, and a roller which is attached to the arm portion to be rotatable in the sheet width direction, and the pressing member is selectively disposed in a first position where the roller presses down the upstream-side end part of a sheet discharged onto the discharge tray, or in a second position where the roller contacts a lower surface of a sheet on the processing tray.

7 Claims, 3 Drawing Sheets

(51) Int. Cl.
*B65H 31/30* (2006.01)
*B65H 33/08* (2006.01)

(52) U.S. Cl.
CPC ..... *B65H 2701/18292* (2013.01); *B65H 2801/06* (2013.01); *B65H 2801/27* (2013.01)

(56) References Cited

U.S. PATENT DOCUMENTS

| | | | | |
|---|---|---|---|---|
| 2013/0026695 | A1* | 1/2013 | Tokuma ..... | B65H 31/34<br>270/58.07 |
| 2014/0061994 | A1* | 3/2014 | Mimura ..... | B65H 29/14<br>270/58.09 |

* cited by examiner

SHEET POST-PROCESSING APPARATUS AND IMAGE FORMING SYSTEM INCLUDING SAME

INCORPORATION BY REFERENCE

This application is based upon and claims the benefit of priority from the corresponding Japanese Patent Application No. 2015-133714 filed on Jul. 2, 2015, the entire contents of which are incorporated herein by reference.

BACKGROUND

The present disclosure relates to a sheet post-processing apparatus which performs post-processing such as binding processing and shift discharge processing on sheets, such as paper sheets, on which images have been formed by an image forming apparatus, such as a copier, a facsimile machine, a printer, etc., and an image forming system including the same.

Conventionally, sheet post-processing apparatuses are used which are capable of performing sheet post-processing, such as binding processing of stacking, as a paper sheet bundle, a plurality of paper sheets (sheets) on each of which an image has been formed by an image forming apparatus such as a copier, a printer, etc., and binding the stacked paper sheet bundle by means of a stapler, punch-hole forming processing of punching a hole (perforation) by means of a punch-hole forming device, and shift discharge processing of discharging paper sheet bundles each including a predetermined number of paper sheets to positions shifted from each other.

In such a sheet post-processing apparatus, there are provided a processing tray on which a paper sheet on which an image has been formed is loaded, a discharge tray disposed on a downstream side of the processing tray in a sheet conveyance direction, and a discharge roller pair which discharges the paper sheet on the processing tray onto the discharge tray. With such a configuration, on the processing tray or the like, the binding processing and the shift discharge processing, etc. are performed. Further, there is also known an image forming apparatus provided with a shift member which moves a paper sheet bundle in a sheet width direction in order to align a side end of the paper sheet bundle on the processing tray before the binding processing, or in order to perform the shift discharge processing.

SUMMARY

To achieve the above object, according to a first aspect of the present disclosure, a sheet post-processing apparatus includes a processing tray, a shift member, a discharge tray, a discharge roller pair, and a pressing member. On the processing tray, a sheet is loaded. The shift member moves a sheet loaded on the processing tray in a sheet width direction which is orthogonal to a sheet conveyance direction. The discharge tray is disposed on a downstream side of the processing tray in the sheet conveyance direction. The discharge roller pair discharges the sheet on the processing tray onto the discharge tray. The pressing member presses down an upstream-side end part of the sheet discharged onto the discharge tray. The pressing member has an arm portion which rotates in the sheet conveyance direction about a rotation fulcrum, and a roller attached to the arm portion to be rotatable in the sheet width direction. The pressing member is selectively disposed in a first position in which the roller presses down an upstream-side end part of a sheet discharged onto the discharge tray, or in a second position in which the roller contacts a lower surface of a sheet on the processing tray.

Still other objects and specific advantages of the present disclosure will become apparent from the following descriptions of preferred embodiments.

DETAILED DESCRIPTION

Hereinafter, embodiments of the present disclosure will be described with reference to the accompanying drawings. First, a description will be given of an image forming system composed of an image forming apparatus 100, and a sheet post-processing apparatus 20 of the present disclosure. In the present embodiment, a multifunction peripheral is dealt with as an example of the image forming apparatus 100, but the sheet post-processing apparatus 20 of the present disclosure is equally connectable to an image forming apparatus other than a multifunction peripheral, such as a laser printer, an inkjet printer, a facsimile machine, etc.

Figure 1:
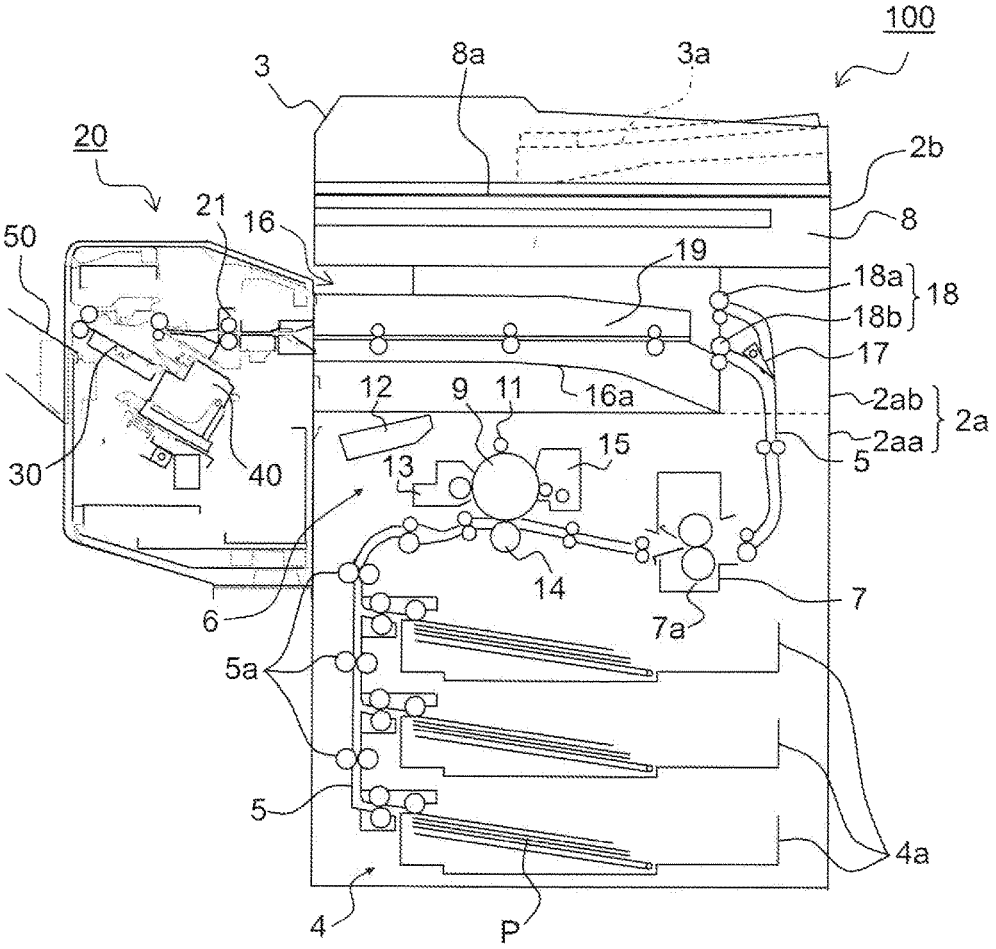
FIG. 1 is a schematic diagram illustrating interior configurations of an image forming apparatus and a sheet post-processing apparatus according to an embodiment of the present disclosure.

As illustrated in FIG. 1, the image forming apparatus 100 is a so-called in-housing sheet discharge type digital multifunction peripheral, and is broadly composed of a main body housing 2*a* and an upper housing 2*b* arranged above the main body housing 2*a*. In the upper housing 2*b*, there are provided later-described various mechanisms for reading images of documents as electric signals, and to an upper part of the upper housing 2*b*, a document feeding device 3 is attached. On the other hand, in the main body housing 2*a*, there are provided later-described various mechanisms for transferring images onto paper sheets (sheets) based on the electric signals of the read images of documents, and the sheet post-processing apparatus 20 is attached to a left-side part of the main body housing 2*a*.

In the present embodiment, the main body housing 2*a* is composed of a lower housing 2*aa* and a connection housing 2*ab* which is disposed above the lower housing 2*aa* to be positioned along a right-side part of the lower housing 2*aa*, and which is connected with the upper housing 2*b*. The lower housing 2*aa* is provided with a sheet feeding unit 4 for paper sheets P, an image forming unit 6 which forms a toner image on the paper sheet P, a fixing device 7 for fixing the toner image on a paper sheet P, etc., and on the other hand, the connection housing 2*ab* is provided with a sheet discharge unit (a discharge unit) 18 for conveying a paper sheet P on which a toner image has been fixed to discharge the paper sheet P from the main body housing 2*a*.

Further, directly below the upper housing 2*b*, to the left of the connection housing 2*ab*, there is formed an in-housing sheet discharge space 16 is formed to be widely open leftward and frontward, and in the in-housing sheet discharge space 16, there is provided a relay unit 19 which receives, and is loaded with, the paper sheet P discharged via a left side face of the connection housing 2*ab*, and which allows the paper sheet P to be conveyed to the sheet post-processing apparatus 20 in a case where predetermined post processing is going to be performed on the paper sheet P.

Inside the main body housing 2*a*, the sheet feeding unit 4 is arranged in a lower part of the main body housing 2*a*, a sheet conveyance path 5 is arranged beside and above the sheet feeding unit 4, the image forming unit 6 is arranged above the sheet feeding unit 4, and the fixing device 7 is arranged on a downstream side (a right side in FIG. 1) of the image forming unit 6 in a sheet conveyance direction.

The sheet feeding unit 4 includes a plurality of sheet feeding cassettes 4*a* each provided with separating-feeding-conveying means such as a sheet feeding roller disposed downstream thereof in the sheet conveyance direction, and one paper sheet P after another from stacks of paper sheets P placed on any of the sheet feeding cassettes 4*a* is fed to the sheet conveyance path 5 starting with a topmost paper sheet P. In the sheet conveyance path 5, a paper sheet P is fed from the sheet feeding unit 4 to the image forming unit 6 by means of conveyance roller pairs 5*a*.

The image forming unit 6 and the fixing device 7 are arranged in the image forming apparatus 100 in a manner elongated in a width direction (a front-rear direction, a direction orthogonal to a sheet surface of FIG. 1) which is orthogonal to the sheet conveyance direction, and they are arranged side by side along the direction in which a paper sheet P is conveyed (that is, from left to right) in the order of the image forming unit 6 and the fixing device 7 from the left side in FIG. 1.

The image forming unit 6 forms a predetermined toner image on a paper sheet P by means of an electrophotographic process, and includes a photosensitive drum 9 as an image carrier rotatably supported on a shaft, and the following components arranged around the photosensitive drum 9 along its rotation direction, namely, a charging device 11, an exposure device 12, a developing device 13, a transfer device 14, a cleaning device 15, and an unillustrated electricity removal device. The fixing device 7 makes a fixing roller pair 7*a* composed of a pair of rollers, one of which is a heat roller and the other of which is a pressure roller, sandwich a paper sheet P onto which a toner image has been transferred at the image forming unit 6, to apply heat and pressure to the paper sheet P, and thereby fixes the non-fixed toner image onto the paper sheet P.

The upper housing 2*b* is provided therein with an image reading unit 8. The image reading unit 8 reads image information of a document. In a case of manually placing documents one by one for reading, the document feeding device 3 is opened and the documents are placed one by one on a contact glass 8*a* provided on an upper surface of the upper housing 21, whereas in a case of automatically reading one document after another from a bundle of documents, the document feeding device 3 is closed and the bundle of documents is stacked on a document feeding tray 3*a* of the document feeding device 3. In the case where the bundle of documents is stacked on the document feeding tray 3*a*, the documents are automatically fed onto the contact glass 8*a* one after another from the bundle of documents. In whichever case, light is shone onto each document positioned on the contact glass 8*a* from an unillustrated exposure lamp, and light reflected from each document is guided as image light to a photoelectric conversion unit (CCD) via an optical system including a reflection mirror, an image forming lens, etc. (none of which is illustrated).

Hereinafter, basic operation of the image forming apparatus 100 having the above configuration will be described. First, a surface of the photosensitive drum 9, which rotates in a counterclockwise direction in FIG. 1, is uniformly charged by the charging device 11. Next, a laser beam from the exposure device 12 (a laser device or the like) is shone onto a circumferential surface of the photosensitive drum 9 based on the image information read by the image reading unit 8, whereby an electrostatic latent image is formed on the surface of the photosensitive drum 9. Toner as a developer is fed from the development device 13 onto this electrostatic latent image, whereby a toner image is formed.

Next, a paper sheet P from the sheet feeding unit 4 passes through the sheet conveyance path 5, to be conveyed at predetermined timing to the photosensitive drum 9 on which the toner image has been formed, and there, the toner image on the surface of the photosensitive drum 9 is transferred onto the paper sheet P by the transfer device 14 including a transfer roller, for example. Then, the paper sheet P, to which the toner image has been transferred, is separated from the photosensitive drum 9, to be transferred to the fixing device 7. The paper sheet P is subjected to heating and pressurization processing while passing through the fixing roller pair 7*a*, whereby the toner image is fixed onto the paper sheet P.

After the completion of the processing of transferring the toner image onto the paper sheet P, the photosensitive drum 9 has residual toner remaining on its circumferential surface removed by the cleaning device 15, and then is subjected to electricity removing processing to have residual charge removed by the electricity removal device (not shown). Thereafter, the charging device 11 performs charging processing on the circumferential surface of the photosensitive drum 9 again, and then image formation is repeated in the same manner.

The paper sheet P having passed through the fixing device 7 is conveyed directly upward vertically into the connection housing 2*ab* through the sheet conveyance path 5. The sheet conveyance path 5 branches at its upper part into two, upper and lower, conveyance paths extending leftward inside the connection housing 2*ab*, such that a switching claw 17, which is disposed at the branching part, switches the sheet conveyance direction for the paper sheet P.

The connection housing 2*ab* is provided therein with a sheet discharge unit 18. The sheet discharge unit 18 has an upper discharge roller pair 18*a*, and a lower discharge roller pair 18*b* disposed directly below the upper discharge roller pair 18*a*. A paper sheet P conveyed along the sheet conveyance path 5 is guided into an upper conveyance path or a lower conveyance path by the switching claw 17.

A paper sheet P guided into the upper conveyance path by the switching claw 17 is discharged leftward via the upper discharge roller pair 18*a*, whereas a paper sheet P guided into the lower conveyance path by the switching claw 17 is discharged leftward via the lower discharge roller 18*b*. The switching of directions in which a paper sheet P is to be guided by the switching claw 17 is controlled by an unillustrated control unit. Here, the control unit is provided in the image forming apparatus 100, and controls the entire image forming system (the image forming apparatus 100 and the sheet post-processing apparatus 20).

The relay unit 19 is detachably/attachably attached on a bottom surface 16*a* of the in-housing discharge space 16, and a detection sensor (not shown) is provided in the in-housing discharge space 16 to detect attachment of the relay unit 30. The detection sensor is composed of, for example, a PI sensor, and transmits a detection result to the control unit.

Further, the bottom surface 16*a* is provided with a slope that is inclined upward toward a downstream side (the left side in FIG. 1) in a sheet discharge direction, and when the relay unit 19 is removed from the in-housing discharge space 16, the bottom surface 16*a* is used as a sheet discharge tray. In this case, the detection sensor detects that the relay unit 19 is not attached, and when the detection result is transmitted to the control unit, the switching claw 17 guides a paper sheet P to the upper discharge roller pair 18*a*. Then, the paper sheet P is discharged from the upper discharge roller pair 18*a* onto the bottom surface 16*a*.

On the other hand, when the detection sensor detects that the relay unit 19 is attached in the in-housing discharge space 16, and the detection result is transmitted to the control unit, the switching claw 17 guides a paper sheet P to the lower discharge roller pair 18*b*. Then, the paper sheet P discharged from the lower discharge roller pair 18*b* is brought into the relay unit 19. The paper sheet P brought into the relay unit 19 passes through the relay unit 19 to be brought into the sheet post-processing apparatus 20.

Here, it is also possible to display the detection result on an operation unit (unillustrated) for the user to switch, via an operation panel, the direction in which a paper sheet P is to be guided. Further, an upper surface part of the relay unit 19 constitutes a sheet discharge tray on which is placed a paper sheet P discharged from the upper discharge roller pair 18*a*.

The sheet post-processing apparatus 20 is provided therein with a punch-hole forming device 21 which performs punch-hole formation with respect to a paper sheet P brought into the sheet post-processing apparatus 20, a processing tray 30 for loading (stacking) thereon a plurality of paper sheets P brought into the sheet post-processing apparatus 20, and a stapler 40 which binds a bundle of paper sheets placed on the processing tray with a staple. On a side surface of the sheet post-processing apparatus 20, there is provided a discharge tray 50 which is vertically movable to a position suitable for discharge of the paper sheet P.

The punch-hole forming device 21 is disposed in an upper part of the sheet post-processing apparatus 20, and forms a plurality of punch holes along a side-end edge (on the apparatus front or rear side) of a paper sheet P that is parallel to the conveyance direction of the paper sheet P. At a substantially center part in a direction orthogonal to the sheet conveyance direction (a direction perpendicular to the surface of the sheet of FIG. 1), on the upstream side of the punch-hole forming device 21, there is disposed a sheet introduction detection sensor (not shown) which detects a leading end of a paper sheet P brought into the sheet post-processing apparatus 20 by a sheet introduction roller pair disposed in the relay unit 19.

The control unit (not shown) controls driving of the sheet introduction roller pair disposed in the relay unit 19 based on timing of detection of the leading end of the sheet P by the sheet introduction detection sensor, and thereby adjusts punch-hole forming positions in the conveyance direction of the paper sheet P conveyed to the punch-hole forming device 21. Specifically, there is set a conveyance direction pulse adjustment value for adding/subtracting to/from a reference conveyance pulse value from when the leading end or the rear end of a paper sheet P is detected by the sheet introduction detection sensor until the sheet introduction roller pair is stopped.

Figure 2:
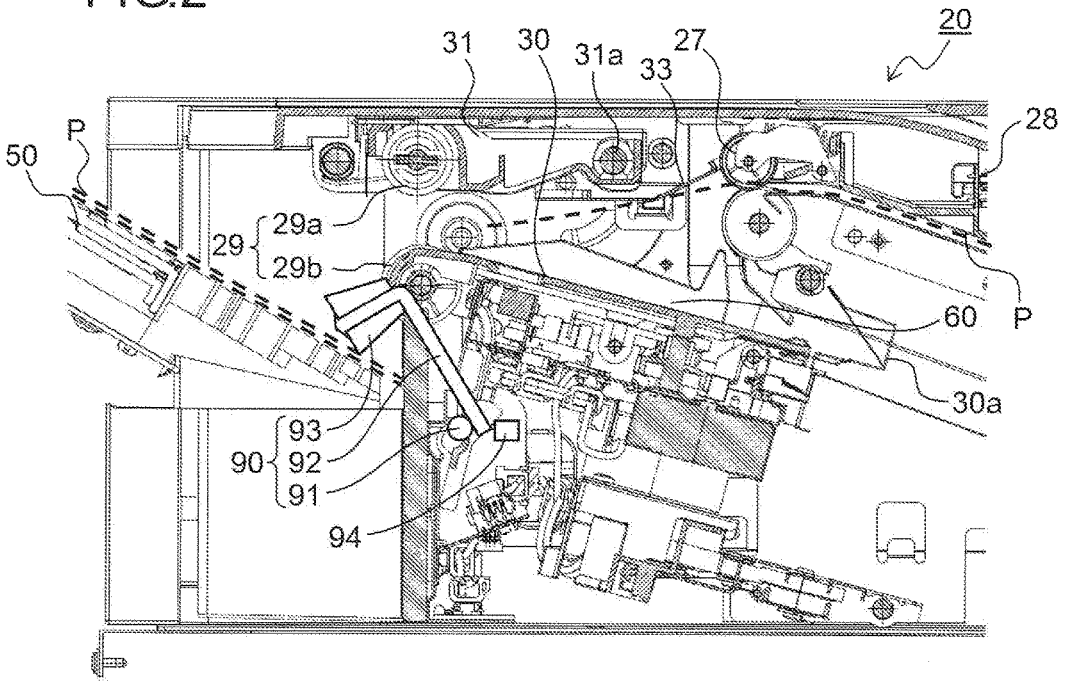
FIG. 2 is an enlarged view of a part around a processing tray of a sheet post-processing apparatus according to an embodiment of the present disclosure, in a state where a pressing member is disposed in a first position.
Figure 3:
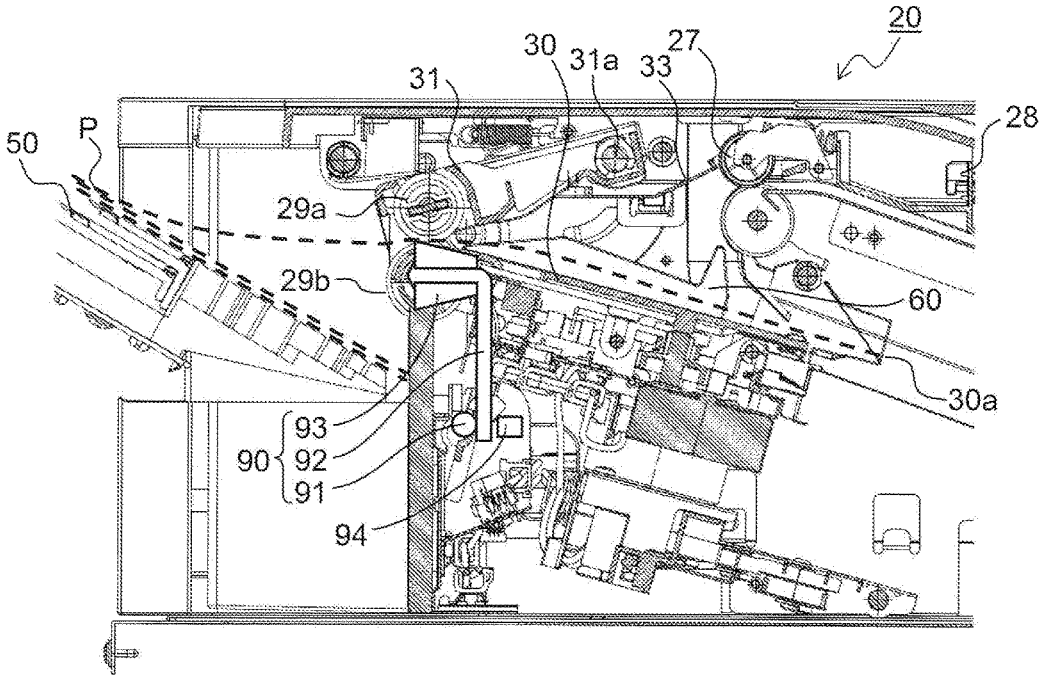
FIG. 3 is an enlarged view of a part around a processing tray of a sheet post-processing apparatus according to an embodiment of the present disclosure, in a state where a pressing member is disposed in a second position.

FIG. 2 and FIG. 3 are sectional views of a part around the processing tray 30 in the sheet post-processing apparatus 20. A first discharge roller pair 27 is arranged on a downstream side of the punch-hole forming device 21 (see FIG. 1) with respect to the sheet conveyance direction. An actuator-type sheet detection sensor 28 is disposed on an upstream side of the first discharge roller pair 27.

Further, below the first discharge roller pair 27, the processing tray 30 for loading thereon in an aligned manner a predetermined number of paper sheets P conveyed thereto by the first discharge roller pair 27, and the stapler 40 (see FIG. 1) which performs binding processing on a stack of paper sheets P (a paper sheet bundle) loaded on the processing tray 30 are provided.

On a downstream side of the processing tray 30 with respect to the sheet conveyance direction, there is arranged a second discharge roller pair 29 which discharges a paper sheet bundle from the processing tray 30 onto the discharge tray 50. The second discharge roller pair 29 is constituted by four discharge roller pairs 29 provided along the sheet width direction (a direction perpendicular to the surface of the sheet of FIG. 2, a direction orthogonal to the sheet conveyance direction). Further, each second discharge roller pair (discharge roller pair) 29 is composed of an upper discharge roller 29*a* which is made of rubber and rotatable forward and backward by being driven by a drive motor (not shown), and a lower discharge roller 29*b* which is made of rubber and caused to rotate by the rotation of the upper discharge roller 29*a*. The upper discharge roller 29*a* is supported by a roller holder 31 which is swingable up and down with a rotation shaft 31*a* as a fulcrum.

Above the processing tray 30, on a downstream side of the first discharge roller pair 27 (a left side in FIG. 2), there is arranged a tapping member 33 for tapping a paper sheet P brought in by the first discharge roller pair 27 in a direction toward the processing tray 30 to thereby make the paper sheet P lie flat along a surface of the processing tray 30. The processing tray 30 is provided in such a manner as to be inclined downward toward the rear end side (a right side in FIG. 2) of a paper sheet P loaded thereon, and backward rotation of the second discharge roller pair 29 causes a paper sheet P to be drawn onto the processing tray 30 from its rear end side, so that the rear end of the paper sheet P bumps against a strike portion 30*a*. Thereby, a paper sheet bundle is placed on the processing tray 30 with its rear end evened up. Further, the processing tray 30 is provided with a pair of side end alignment cursors (a shift member) 60 which align a predetermined number of sheets in a paper sheet bundle loaded on the processing tray 30 in the sheet width direction which is orthogonal to the sheet conveyance direction.

The stapler 40 is movable in the sheet width direction by a moving mechanism (not shown), and moves along a lower end part of the processing tray 30 to a predetermined position according to what is instructed to do in the binding processing.

The discharge tray 50 is provided in such a manner as to be inclined downward toward the rear end side (the right side in FIG. 2) of a paper sheet bundle loaded thereon. On an upstream side of the discharge tray 50 (the right side in FIG. 2), there is provided a pressing member 90 which presses an upstream-side end part of a paper sheet bundle discharged onto the discharge tray 50. The pressing member 90 is composed of a substantially L-letter shaped arm portion 92 which rotates about a rotation fulcrum 91 in the sheet conveyance direction, and a roller 93 which is made of rubber and attached to an end part of the arm portion 92 to be rotatable in the sheet width direction.

By rotating about the rotation fulcrum 91, the pressing member 90 is selectively disposed in a first position (the position illustrated in FIG. 2) in which an upstream-side end part of a paper sheet bundle discharged onto the discharge tray 50 is pressed down by the roller 93, and a second position (the position illustrated in FIG. 3) in which the roller 93 contacts a lower surface of a paper sheet P on the processing tray 30.

The roller 93 is substantially circular truncated cone shaped such that a downstream-side (the left side in FIG. 2) part of the roller 93 with respect to the sheet conveyance direction is formed with a larger diameter than an upstream-side (the right side in FIG. 2) part of the roller 93. As a result, when the pressing member 90 is in the second position, an upstream end of the roller 93 is disposed below a circumferential surface of the lower discharge roller 29*b* (or a tray surface (sheet placing surface) of the processing tray 30), whereas a downstream-side part of the roller 93 projects above the circumferential surface of the lower discharge roller 29*b*. Further, the upstream end of the roller 93 is disposed below a topmost part of the circumferential surface of the lower discharge roller 29*b*, whereas a downstream end of the roller 93 projects above the topmost part of the circumferential surface of the lower discharge roller 20*b*.

Figure 4:
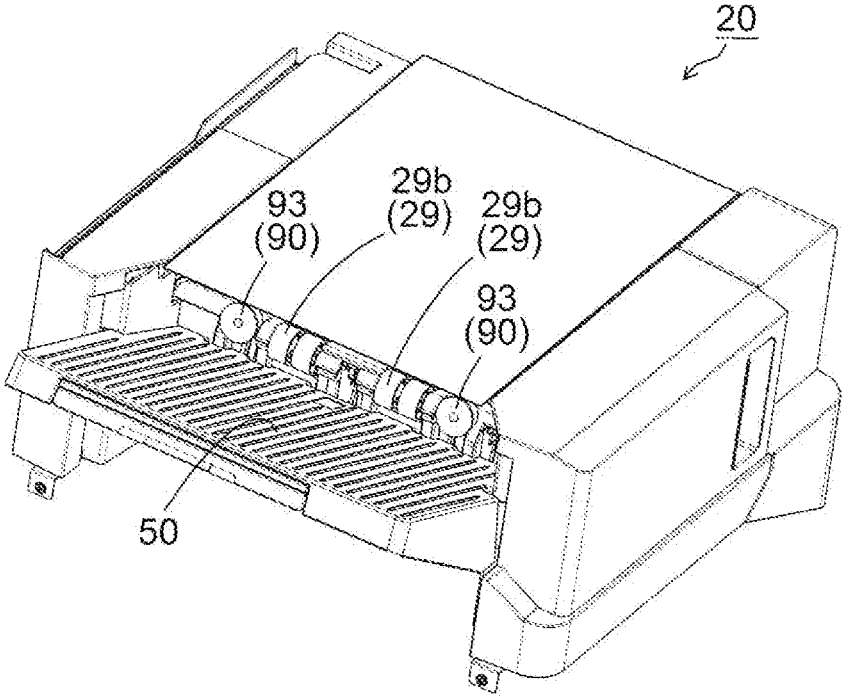
FIG. 4 is a perspective view of a structure of a sheet post-processing apparatus according to an embodiment of the present disclosure.

Further, as illustrated in FIG. 4, the pressing member 90 is constituted by two pressing members 90 provided along the sheet width direction such that two rollers 93 of the two pressing member 90 are each disposed at a position that is close to the lower discharge rollers 29*b* and exterior to the lower discharge rollers 29*b*.

As illustrated in FIG. 2 and FIG. 3, an angle sensor 94 is provided near the arm portion 92 of the pressing member 90 to detect an angle of inclination of the arm portion 92. The angle sensor 94 transmits a detection result to the control unit (not shown). The control unit is capable of detecting an amount of paper sheets placed on the discharge tray 50 based on the detection result (the angle of inclination of the arm portion 92) received from the angle sensor 94, and vertically moves the discharge tray 50 such that a topmost surface of a paper sheet bundle placed on the discharge tray 50 is disposed at a predetermined height.

Next, a description will be given of operation of the sheet post-processing apparatus 20. When a paper sheet P (indicated by broken lines in FIG. 2 and FIG. 3) that has undergone the image forming processing in the image forming apparatus 100 is brought into the sheet post-processing apparatus 20, in a case where an instruction has been given to perform punch-hole formation, punch holes are formed at predetermined positions (two positions along a side edge on the apparatus front side, for example) in the conveyed paper sheet P by the punch-hole forming device 21, whereas in a case where no instruction has been given to perform the punch-hole formation, the paper sheet P passes through the punch-hole forming device 21 without being subjected to the punch-hole formation.

Then, the paper sheet P is conveyed by the first discharge roller pair 27 to a further downstream side. At this time, as illustrated in FIG. 2, the roller holder 31 has swung upward, and the upper discharge roller 29*a* is disposed in a position (a retraction position) apart from the lower discharge roller 29*b*. Thus, the paper sheet P that has been conveyed by the first discharge roller pair 27 passes through a gap between the upper discharge roller 29*a* and the lower discharge roller 29*b*, to project over the discharge tray 50. Further, at this time, the pressing member 90 is disposed in the first position, and a paper sheet bundle on the discharge tray 50 is pressed down by the roller 93.

At timing when the rear end of the paper sheet P passes through the first discharge roller pair 27, the roller holder 31 is swung downward to move the upper discharge roller 29*a* into a position (contact position) in which the upper discharge roller 29*a* is in contact with the lower discharge roller 29*b*. Thereafter, the tapping member 33 is driven to lay the paper sheet P flat along the surface of the processing tray 30. By the upper discharge roller 29*a* rotating backward (in the counterclockwise direction in FIG. 3) in this state, the paper sheet P is drawn in along the processing tray 30, and the rear end of the paper sheet P is aligned by the strike portion 30*a*. Note that the strike portion 30*a* is not formed continuously all over an area along the sheet width direction, but has a cut formed therein. At this time, a center part of the paper sheet P is nipped by the second discharge roller pair 29, and the leading end of the paper sheet P projects over the discharge tray 50 from the second discharge roller pair 29. When drawing in the paper sheet P along the processing tray 30, to avoid drawing in the paper sheet P by an amount more than necessary, the paper sheet P is nipped with the upper discharge roller 29*a* pressed against the lower discharge roller 29*b* by the weight of the roller holder 31 alone.

Then, when reception of a bundle (a predetermined number) of paper sheets P is completed, in a case where an instruction has been given to perform the binding processing, the stapler 40 is caused to move to the position of the cut formed in the strike portion 30*a*, where the binding processing is performed on the rear end of the paper sheet bundle.

In a case where the shift discharge processing has been set to be performed, the roller holder 31 is caused to move to the retraction position, and the pressing member 90 is disposed in the second position. Thereafter, the side end alignment cursors 60 are each disposed in a position (a reference position) where the paper sheets P have been received, or in a position (a shift position) that is shifted a predetermined amount from the reference position in a direction (the sheet width direction) orthogonal to a discharge direction. Then, the pressing member 90 is disposed in the first position, and the roller holder 31 is caused to move to the contact position. Thereafter, the upper discharge roller 29*a* is rotated forward (in the clockwise direction in FIG. 3), and the paper sheet bundle is thereby conveyed upward along the processing tray 30, to be discharged onto the discharge tray 50. Thereby, paper sheet bundles are discharged onto the discharge tray 50, alternately to a reference discharge position and to a shift discharge position shifted a predetermined amount from the reference position in a direction (the sheet width direction) orthogonal to the discharge direction, and the paper sheet bundles are sorted from each other by being loaded on the discharge tray 50, in alternate positions in the sheet width direction, when discharged onto the discharge tray 50. Here, when discharging a paper sheet bundle onto the discharge tray 50, the upper discharge roller 29*a* is pressed against the lower discharge roller 29*b* not only with the weight of the roller holder 31 but also by biasing the roller holder 31 downward by a biasing member such as a spring. Thereby, the paper sheet bundle is nipped with a force stronger than the force with which a paper sheet P is nipped when it is drawn in, and thus the paper sheet bundle can be securely discharged onto the discharge tray 50.

In the present embodiment, as has been described above, the pressing member 90 is selectively disposed in the first position, in which the upstream-side end part of a paper sheet P discharged onto the discharge tray 50 is pressed down by the roller 93, and the second position, in which the roller 93 contacts the lower surface of a paper sheet P on the processing tray 30. Thereby, in moving a paper sheet P on the processing tray 30 in the sheet width direction when the pressing member 90 is disposed in the second position, it is possible to smoothly move the paper sheet P in the sheet width direction by means of the roller 93 contacting the lower surface of the paper sheet P, and this helps reduce occurrence of misalignment of the paper sheet P.

Moreover, since a paper sheet P discharged onto the discharge tray 50 can be pressed down by disposing the pressing member 90 in the first position, it is possible to reduce occurrence of the paper sheet P warping to partly float above the surface of the discharge tray 50, or reduce occurrence of the paper sheet P on the discharge tray 50 being pushed out of the discharge tray 50 to fall when a following paper sheet P is discharged onto the discharge tray 50.

Furthermore, since the pressing member 90 provided for pressing down a paper sheet P discharged onto the discharge tray 50 functions also as a member for helping a paper sheet P on the processing tray 30 to move smoothly in the sheet width direction, it is possible to reduce increase in number of components.

Moreover, as described above, in a state where the pressing member 90 is disposed in the second position, the roller 93 projects above (outward from) the circumferential surface of the lower discharge roller 29*b*. This makes it possible to reduce occurrence of contact of the lower discharge roller 29*b* with a paper sheet P, and thus it is possible to reduce load applied to the paper sheet P from the lower discharge roller 29*b* when moving the paper sheet P on the processing tray 30 in the sheet width direction. As a result, the paper sheet P can be moved more smoothly in the sheet width direction, and thus occurrence of misalignment of the paper sheet P can be further reduced. Furthermore, since it is possible to further reduce occurrence of contact of the lower discharge roller 29*b* with the paper sheet P by making the downstream-side end of the roller 93 project above the topmost part of the circumferential surface of the lower discharge roller 29*b* in a state where the pressing member 90 is disposed in the second position, it is possible to further reduce the load applied to the paper sheet P from the lower discharge roller 29*b* when moving the paper sheet P on the processing tray 30 in the sheet width direction.

Moreover, as described above, in loading a paper sheet P on the processing tray 30, by disposing the pressing member 90 in the first position, it is possible to guide the leading end of the paper sheet P that has passed over the lower discharge roller 29*b* by means of the roller 93 to the downstream side in the discharge tray 50, and this helps reduce occurrence of jams caused by curling of the leading end of the paper sheet P. Furthermore, since the pressing member 90 presses down a paper sheet P on the discharge tray 50, it is possible to reduce occurrence of a paper sheet P on the discharge tray 50 being pushed out of the discharge tray 50 by the leading end of the paper sheet P that has passed over the lower discharge roller 29*b*.

Further, as described above, a downstream-side part of the roller 93 is formed with a larger diameter than an upstream-side part of the roller 93. Thereby, when a paper sheet P is conveyed onto the processing tray 30 when no paper sheet P is placed thereon, it is possible to make the downstream-side part of the roller 93 in the second position securely contact the lower surface of the paper sheet P while reducing occurrence of the leading end of the paper sheet P being caught by an upstream-side part of the roller 93.

Further, as described above, the roller 93 is disposed close to the lower discharge roller 29*b* in the sheet width direction. Thereby, it is possible to further reduce the occurrence of contact of the lower discharge roller 29*b* with a paper sheet P in a state where the pressing member 90 is disposed in the second position, and thus it is possible to further reduce the load applied to the paper sheet P from the lower discharge roller 29*b* when moving the paper sheet P on the processing tray 30 in the sheet width direction. As a result, the paper sheet P can be moved more smoothly in the sheet width direction, and thus occurrence of misalignment of the paper sheet P can be further reduced.

Further, as described above, when a paper sheet P is discharged from the processing tray 30 onto the discharge tray 50, the pressing member 90 is disposed in the first position. Thereby, a paper sheet P placed on the discharge tray 50 is pressed down by the pressing member 90, and this helps reduce occurrence of the paper sheet P on the discharge tray 50 being pushed out of the discharge tray 50 by a following paper sheet P to fall.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications within the meaning and range equivalent to the scope of claims for patent are included.

For example, the description of the above embodiment has dealt with, as an example, a configuration where the image forming apparatus 100 and the sheet post-processing apparatus 20 are directly connected to each other, but the present disclosure is applicable also to a configuration where an insert device for slip sheet insertion is mounted between the image forming apparatus 100 and the sheet post-processing apparatus 20.

Further, the description of the above embodiment has dealt with an example where alignment in the sheet width direction is not performed on a paper sheet bundle before the binding processing, but this is not meant to limit the present disclosure. Before the binding processing is performed, a paper sheet bundle may be aligned in the sheet width direction by using the side end alignment cursors 60. Further, when aligning a paper sheet bundle in the sheet width direction before the binding processing, the pressing member 90 may be disposed in the second position.

Further, the description of the above embodiment has dealt with an example where the punch-hole forming processing is performed at a position on an upstream side of the processing tray 30, but this is not meant to limit the present disclosure. For example, the punch-hole forming processing may be performed with respect to a paper sheet bundle on the processing tray 30. In this case, before the punch-hole forming processing is performed, a paper sheet bundle may be aligned by using the side end alignment cursors 60. Further, when aligning a paper sheet bundle in the sheet conveyance direction before the punch-hole forming processing is performed, the pressing member 90 may be disposed in the second position.

Further, the description of the above embodiment has dealt with an example where the pressing member 90 is disposed exterior to the lower discharge roller 29*b* in the sheet width direction, but this is not meant to limit the resent disclosure. For example, the pressing member 90 may be disposed interior to the lower discharge roller 29*b* in the sheet width direction (between a pair of adjacent lower discharge rollers 29*b* and another pair of adjacent lower discharge rollers 29*b*). In this case, only one pressing member 90 may be disposed.

Further, the description of the above embodiment has dealt with an example where the roller 93 is substantially circular truncated cone shaped, but this is not meant to limit the present disclosure. For example, the roller 93 may be cylindrical. In this case, the bending angle of the arm portion 92 may be set such that the roller 93 is inclined upward toward the downstream side in the sheet discharge direction.

Further, the description of the above embodiment has dealt with an example where the roller 93 is made of rubber, but the roller 93 may be made of a material other than rubber, such as resin.

What is claimed is:

1. A sheet post-processing apparatus comprising:

a processing tray on which a sheet is loaded;

a shift member which moves a sheet placed on the processing tray in a sheet width direction which is orthogonal to a sheet conveyance direction;

a discharge tray which is disposed on a downstream side of the processing tray in the sheet conveyance direction;

a discharge roller pair which discharges a sheet on the processing tray onto the discharge tray; and a pressing member which presses down an upstream-side end part of a sheet discharged onto the discharge tray, wherein the pressing member has an arm portion which rotates in the sheet conveyance direction about a rotation fulcrum, a roller which is attached to the arm portion to be rotatable in the sheet width direction, and means for rotating about the rotation fulcrum the pressing member such that the pressing member is selectively disposed in a first position in which the roller presses down an upstream-side end part of a sheet discharged onto the discharge tray, or in a second position in which the roller contacts a lower surface of a sheet on the processing tray.

2. The sheet post-processing apparatus according to claim 1, wherein in a state where the pressing member is disposed in the second position, the roller projects outward from a circumferential surface of a lower discharge roller which constitutes the discharge roller pair.

3. The sheet post-processing apparatus according to claim 1, wherein when the sheet is loaded on the processing tray, the pressing member is disposed in the first position, and when the sheet is moved in the sheet width direction on the processing tray, the pressing member is disposed in the second position.

4. The sheet post-processing apparatus according to claim 1, wherein a downstream-side part of the roller with respect to the sheet conveyance direction is formed with a larger diameter than an upstream-side part of the roller.

5. The sheet post-processing apparatus according to claim 1, wherein in a state where the pressing member is arranged in the second position, the roller is disposed adjacent to the discharge roller pair in the sheet width direction.

6. The sheet post-processing apparatus according to claim 1, wherein when the sheet is discharged from the processing tray onto the discharge tray, the pressing member is disposed in the first position.

7. An image forming system comprising:

the sheet post-processing apparatus according to claim 1; and an image forming apparatus which is connected to the sheet post-processing apparatus, and which forms an image on a sheet and conveys a sheet on which an image has been formed to the sheet post-processing apparatus.

* * * * *